US010856636B2

(12) United States Patent
Hartman et al.

(10) Patent No.: US 10,856,636 B2
(45) Date of Patent: Dec. 8, 2020

(54) PONYTAIL SECURING DEVICE

(71) Applicant: Mountain Girl Way, LLC, Nashville, TN (US)

(72) Inventors: Heidi M. Hartman, Nashville, TN (US); Karen A. D. Cooper, Nashville, TN (US)

(73) Assignee: Mountain Girl Way, LLC

( * ) Notice: Subject to any disclaimer, the term of this patent is extended or adjusted under 35 U.S.C. 154(b) by 338 days.

(21) Appl. No.: 15/962,225

(22) Filed: Apr. 25, 2018

(65) Prior Publication Data

US 2019/0328102 A1 Oct. 31, 2019

(51) Int. Cl.
*A45D 8/34* (2006.01)
*A45D 8/00* (2006.01)

(52) U.S. Cl.
CPC ..... *A45D 8/34* (2013.01); *A45D 2008/004* (2013.01)

(58) Field of Classification Search
CPC ..... A45D 8/34; A45D 8/36; A45D 2008/345; A45D 2008/004; A45D 2008/006; A61C 5/004; A61C 5/0053
See application file for complete search history.

(56) References Cited

U.S. PATENT DOCUMENTS 409,001 A * 8/1889 Ashworth
D90,780 S * 9/1933 Oulton
D158,103 S * 4/1950 Kuenstner ..... D28/41
2,595,657 A * 5/1952 Harmon ..... A45D 8/36 132/273
3,099,271 A * 7/1963 Dubelier ..... A45D 8/34 132/273
3,099,278 A * 7/1963 Keszler ..... A61M 16/00 417/176
3,553,173 A * 1/1971 Wieden et al. ..... C08G 18/50 528/61
4,315,362 A * 2/1982 Pigford ..... A45D 2/00 163/5
5,899,211 A * 5/1999 Brown ..... A45D 8/34 132/201
D413,693 S * 9/1999 Minnelli ..... D28/41
6,213,130 B1 * 4/2001 Alessandrino ..... A45D 8/34 132/200
6,263,884 B1 * 7/2001 Minnelli ..... A45D 8/34 132/201

(Continued)

FOREIGN PATENT DOCUMENTS

GB 2533587 * 12/2014 ..... A45D 8/34

*Primary Examiner* — Rachel R Steitz
*Assistant Examiner* — Brianne E Kalach
(74) *Attorney, Agent, or Firm* — H. Jay Spiegel

(57) ABSTRACT

An elongated thin strand of an elastic material resembles human hair and is wound around and around to form a loop made up of a plurality of revolutions of the strand. A fastener holds the windings together to retain the loop configuration. In the preferred embodiment, the material from which the device is made should be sufficiently elastic that it can stretch at least twice its relaxed length. In a preferred embodiment of the present invention, the thickness of the strand from which the present invention is made should be in the range of 0.1 mm to 1.5 mm, most preferably approximately 0.7 mm. The material that is made is able to receive and retain a coloring dye that enables the manufacturer or user to dye it to match the color of their natural hair.

12 Claims, 8 Drawing Sheets

(56) References Cited

U.S. PATENT DOCUMENTS

| | | | | |
|---|---|---|---|---|
| D765,313 | S * | 8/2016 | Bernal | D28/41 |
| 9,408,451 | B2 * | 8/2016 | Tsai | A45D 8/36 |
| 2004/0168696 | A1 * | 9/2004 | Cox | A41G 3/0041 132/54 |
| 2006/0157077 | A1 * | 7/2006 | Kraft | A45D 8/34 132/200 |
| 2009/0301510 | A1 * | 12/2009 | Hsu | A45D 8/00 132/273 |
| 2010/0236563 | A1 * | 9/2010 | Kimura | A41G 3/00 132/54 |
| 2013/0263884 | A1 * | 10/2013 | Hogan | A45D 8/34 132/273 |
| 2014/0096788 | A1 * | 4/2014 | Krasniansky | A45D 8/34 132/273 |
| 2014/0311518 | A1 * | 10/2014 | Ferreira | A45D 8/36 132/210 |
| 2015/0090290 | A1 * | 4/2015 | Longoria | A45D 8/34 132/275 |
| 2017/0049208 | A1 * | 2/2017 | Trelles-Tvede | A45D 8/34 |
| 2019/0090566 | A1 * | 3/2019 | Lane | A41G 5/008 |

* cited by examiner

PONYTAIL SECURING DEVICE

BACKGROUND OF THE INVENTION

The present invention relates to a ponytail securing device. In the prior art, numerous devices have been developed which are intended to secure a ponytail in place made of the user's hair. Applicants are aware of the following prior art.

U.S. Pat. No. D 229,240 to Fox discloses a fur wrapping for a pigtail which wraps around the pigtail to secure it.

U.S. Pat. No. 5,899,211 to Brown teaches an apparatus and method for securing a ponytail including a plurality of parallel strands with attachment members on each end so that the device may be wrapped around the ponytail with the securing ends secured together.

U.S. Pat. No. 6,263,884 to Minnelli teaches a device for securing a ponytail including a plurality of strands consisting of synthetic hair attached at their ends to an elastic band.

U.S. Pat. No. 6,354,306 to Russell teaches a ponytail holder including woven hair layers.

Published Application No. US 2013/0263884 to Hogan et al. discloses a hair accessory including a plurality of parallel fibers interconnected with a fastening device to allow fastening about a ponytail.

Published Application No. US 2014/0311518 to Ferreira teaches a ponytail wrap including a length of human hair. The length of human hair includes a plurality of parallel fibers.

Published Application No. US 2015/0230579 to Getz discloses a hair band which does not include any synthetic or real hair.

The present invention differs from the teachings of the prior art as set forth above as consisting of a synthetic material which resembles human hair but is elastic in nature and is formed from a winding of a strand of material which is then fastened together and uses its elastic properties to allow winding around a ponytail in one or more loops to secure about a ponytail of the user. In the preferred embodiment, the inventive device is made of a color matching the color of the hair it is fastened to so that it substantially blends in with the hair.

SUMMARY OF THE INVENTION

The present invention relates to a ponytail securing device. The present invention includes the following interrelated objects, aspects and features:

(1) In a first aspect, the present invention is made of an elongated thin strand of an elastic material that resembles human hair. In the preferred embodiments of the present invention, the strand is wound around and around to form a loop made up of a plurality of revolutions of the strand.

(2) If desired, the elongated strand may have beads or other devices mounted thereon at spaced locations to provide ornamentation. Additionally, if desired, the strand may consist of a plurality of strands braided together to form an increased thickness device.

(3) In preferred embodiments of the present invention, the strands may be made of materials such as polyurethane or fibers made of the material SPANDEX®. In the preferred embodiment, the material from which the device is made should be sufficiently elastic that it can stretch at least twice its relaxed length.

(4) In a preferred embodiment of the present invention, the thickness of the strand from which the present invention is made should be in the range of 0.1 mm to 1.5 mm, preferably less than 1 mm and most preferably approximately 0.7 mm.

(5) In a further aspect, the material from which the present invention is made is preferably able to receive and retain a coloring dye that enables the manufacturer or user to dye it to match the color of their natural hair. In this way, it is possible to utilize the inventive device to create and retain a ponytail with the device being substantially invisible to the naked eye. Preferred dyes include acid dyes made by Jacquard and Dharma along with hair dyes made by Revlon, L'Oreal and Clairol. If the manufacturer or user does not desire to employ the present invention in a manner rendering it substantially invisible to the naked eye, other more colorful colors that provide a contrast with the hair of the wearer may be utilized including pinks, purples, blues, etc.

Accordingly, it is a first object of the present invention to provide a ponytail securing device.

It is a further object of the present invention to provide such a device made of a lengthy piece of thin strand-like material wound around and around to form a loop having several revolutions of material.

It is a still further object of the present invention to provide such a device in which the strand of material may be stretched to at least twice its relaxed length.

It is a still further object of the present invention to provide such a device which may be utilized to secure a ponytail on the head of the user.

It is a still further object of the present invention to provide such a device which is made of a material to which hair dye and other dyeing materials can be adhered to provide differing color appearances.

It is a still further object of the present invention to provide such a device in which ornamental decorations can be attached to the strand for an aesthetically pleasing effect.

It is a yet further object of the present invention to provide such a device in which a plurality of strands may be woven together to create a thicker strand and then the thicker strand may be wound around and around to create the ponytail securing device.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
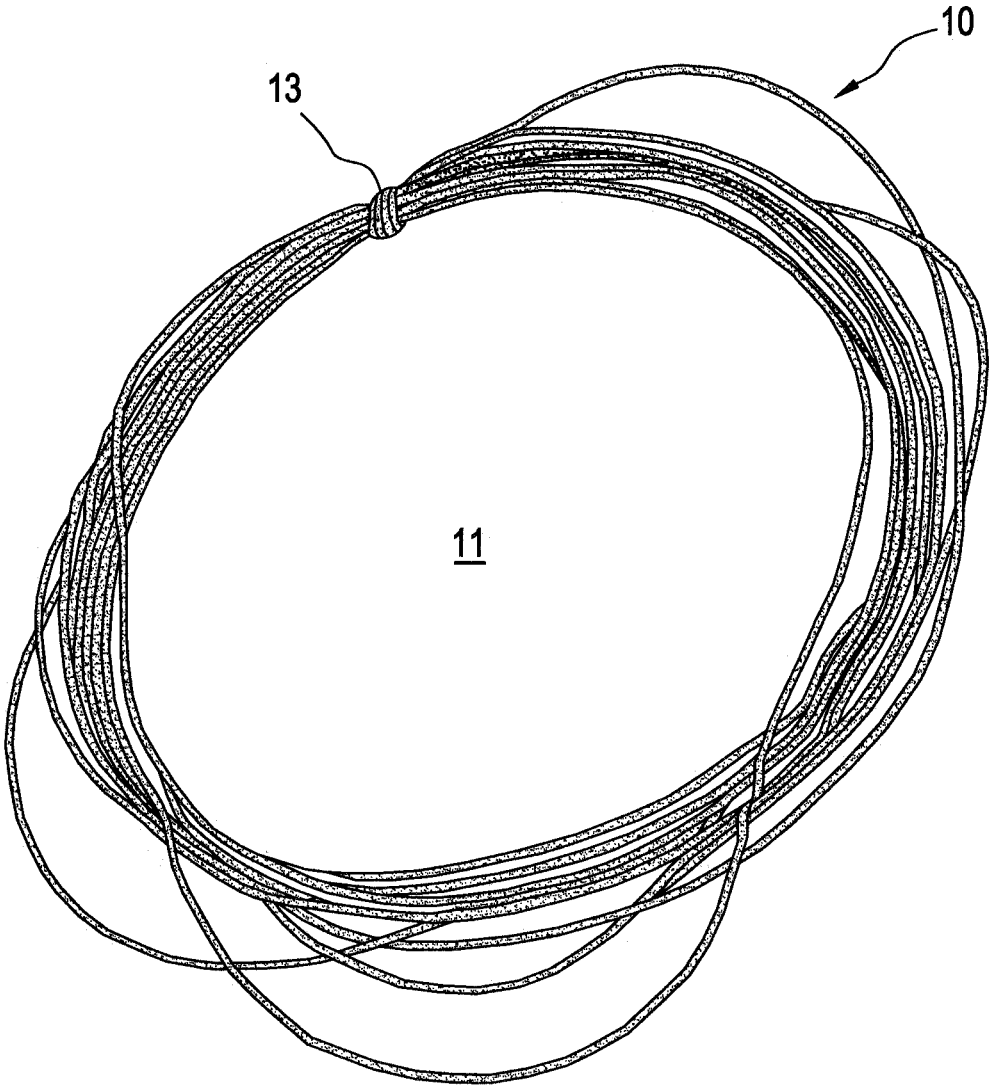
FIG. 1 shows a side view of a first embodiment of the present invention.

With reference first to FIG. 1, a first embodiment of the present invention is shown. As shown, a strand 10 of material is wound around and around numerous times to create a band or loop of material having an opening 11 in the middle of it and a fastener or tie off 13 is provided to bind revolutions of the strand 10 together. The strand can be wound around and around from two revolutions to as many as desired. Plural fasteners of tie offs 13 may be circumferentially spaced about the formed band, as many as desired. As described hereinabove, the material of the strand 10 is an elastic material which may stretch from 1.5 to five times its relaxed length. This enables the band to be stretched as desired to facilitate securing a ponytail in place and when it is relaxed it holds the ponytail in its assembled configuration through tension by the elastic strand material 10.

In the embodiment of FIG. 1 and the other embodiments disclosed hereinafter, the strand 10 is made of a fiber of elastic material having a diameter of about 0.1 to 1.5 millimeters (mm). Examples of materials from which the strand 10 can be made include polyurethane either 100% or a significant proportion or a material made of an elastic fiber sometimes sold under the trademark SPANDEX®. SPANDEX® fibers may, if desired, be produced using titanium dioxide, zirconium compound or carbon black. They are not water soluble and can be encapsulated. Typical human hairs have a diameter of from 0.04 to 0.08 mm. Although the inventive ponytail securing device is made of a thicker strand, it does resemble human hair.

Importantly, one aspect of the fiber chosen for the strand 10 is that it is able to receive and retain a hair dye. This is necessary because one aspect of the present invention is that the strand 10 may be dyed to conform to the color of the user's hair, thereby rendering the device substantially invisible on the user's hair. Dyes that can be used with the strand include acid dyes or hair dyes. Examples of acid dyes that may be used are those manufactured by Jacquard and Dharma. Hair dyes that may be employed include, for example, those manufactured by Revlon, L'Oreal and Clairol.

Materials that are preferably used in making the present invention are preferably fibrous cords that may stretch like a rubber band but do not crimp and have extremely great strength. The fasteners or tie-offs may form a part of the strand, may be separate pieces of strand material or may also be a woven material, one or more beads, include or comprise adhesive, may be formed by partially melting the strand material at discrete locations, may comprise a knot or any other structure that holds together a plurality of revolutions of the strand to form the band.

Figure 2:
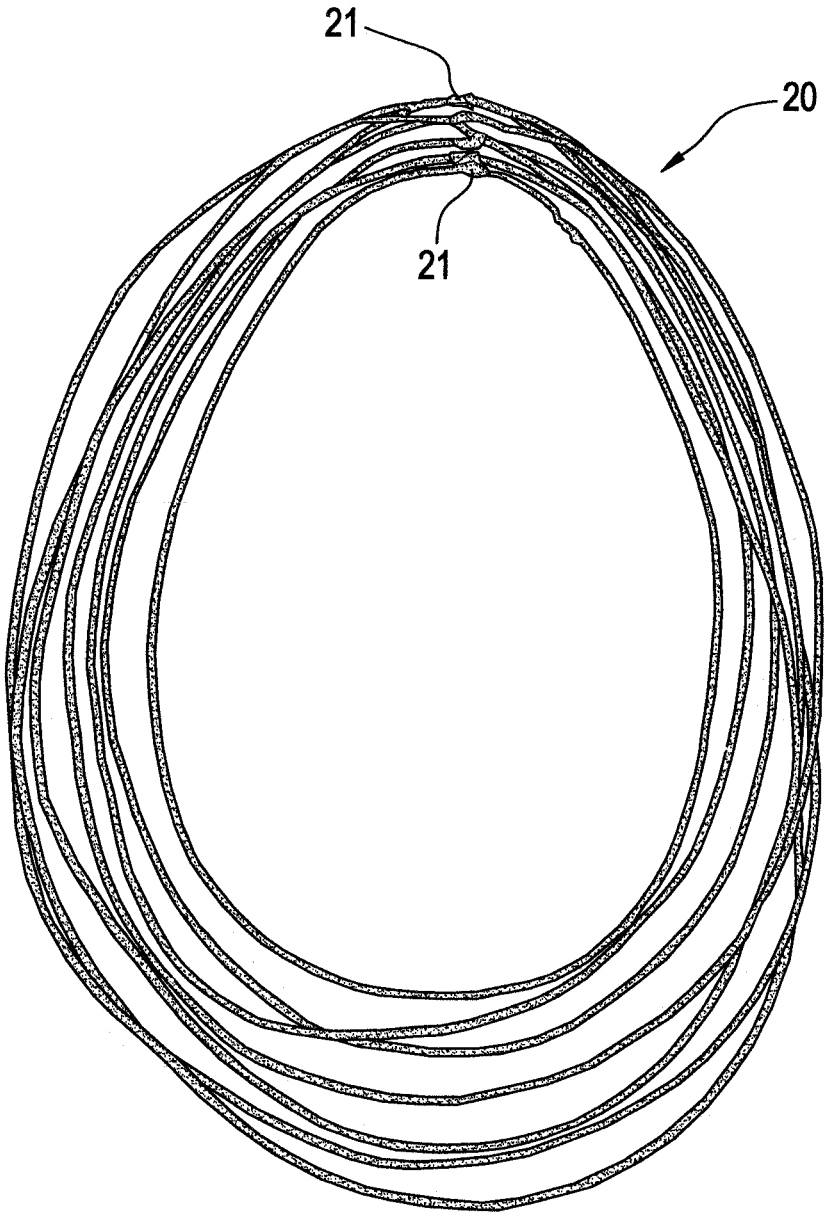
FIG. 2 shows a side view of a second embodiment of the present invention.
Figure 3:
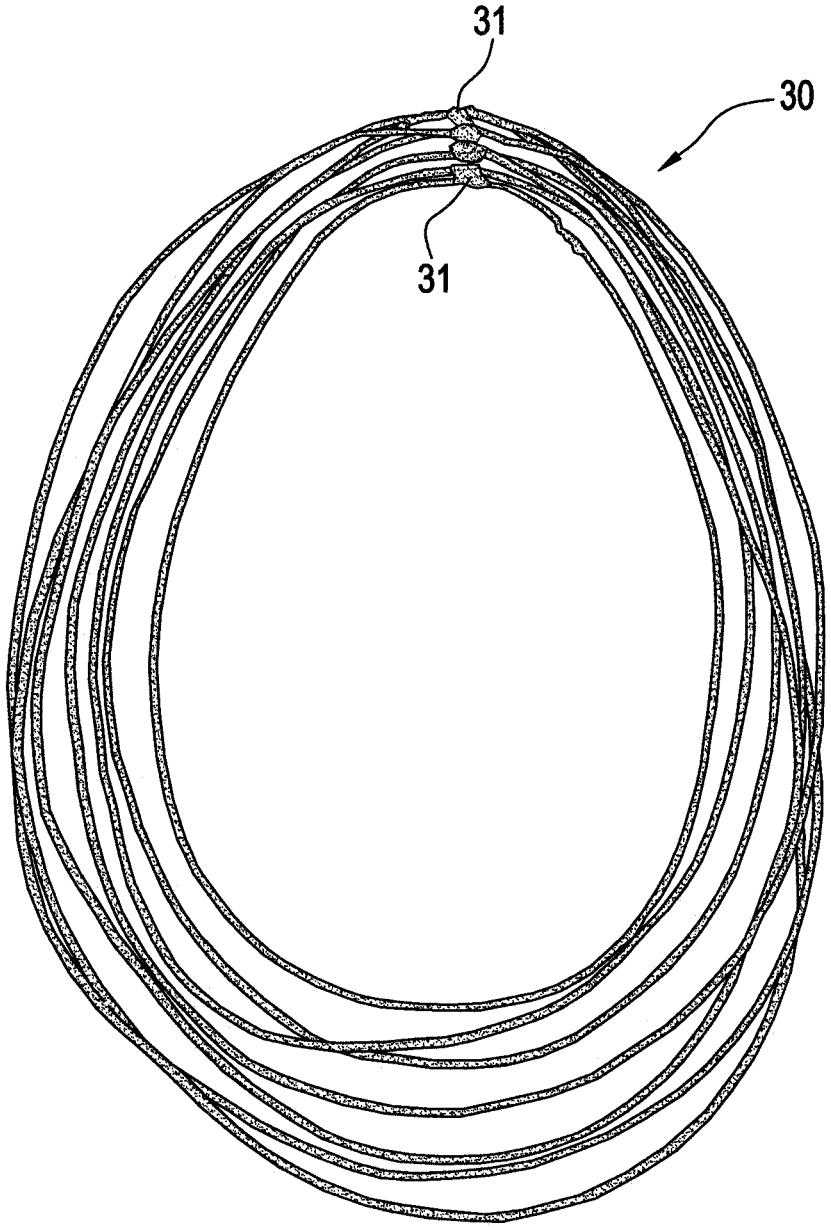
FIG. 3 shows a side view of a still further embodiment of the present invention.

With reference now to FIG. 2, a second embodiment of the present invention is shown and includes a strand 20 which is wound around and around itself to create the securing device. As seen in FIG. 2, the strand 20 may be made up of a plurality of individual strands wound around and around and with their ends fused together by fusings 21 so that the length can be extended. A fastener such as the fastener 13 in FIG. 1 may suitably be employed to hold the windings together. FIG. 3 shows a securing device including a strand 30 made up of a plurality of separate strands attached together with the attachments 31 being more prominent than those shown in FIG. 2.

Figure 4:
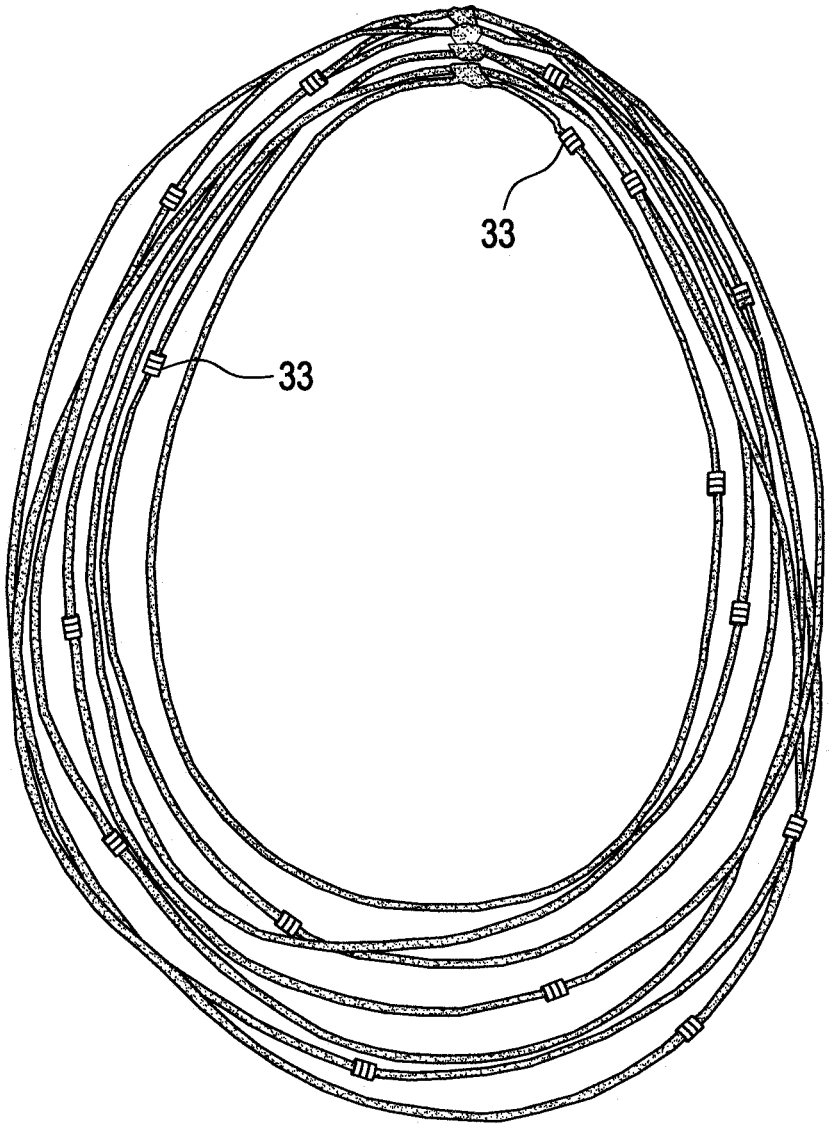
FIG. 4 shows a side view of a yet further embodiment of the present invention in which ornamentation is added to the strand of elastic material.

FIG. 4 shows an embodiment of the securing device similar to that of FIG. 3 but including ornamenting beads 33 provided for decorative purposes to render the securing device aesthetically pleasing under circumstances when it is not desired for it to blend in with the hair that is being secured.

Figure 5:
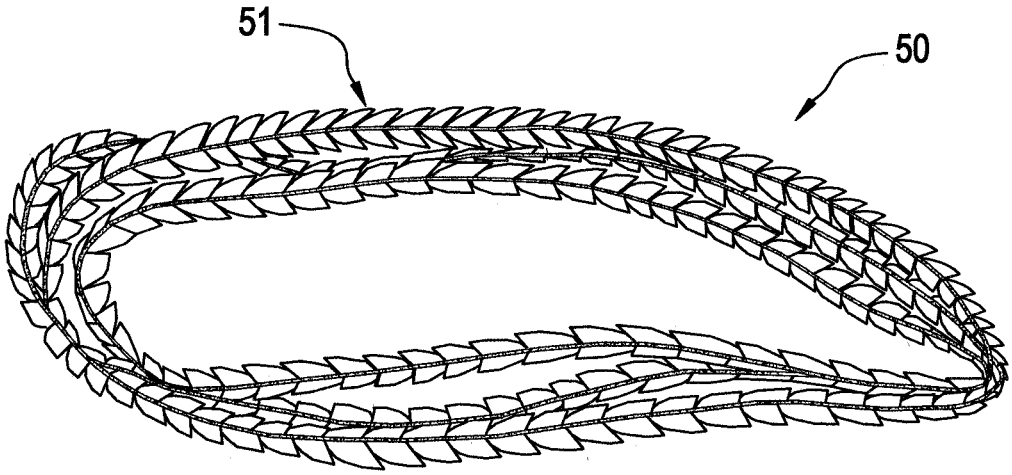
FIG. 5 shows a yet further embodiment of the present invention in which a plurality of strands of elastic material are braided together to form a thicker elastic member and then that elastic member is wound around and around in a spiral fashion to create a band consisting of multiple revolutions of the braided elastic material.
Figure 6:
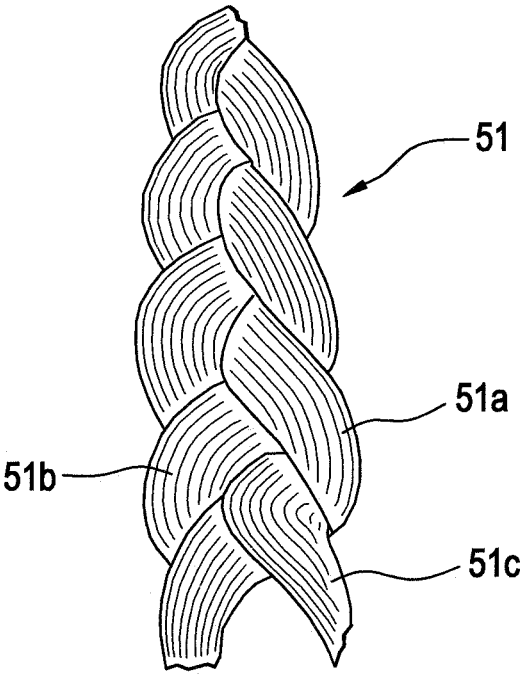
FIG. 6 shows an enlarged close-up view of a portion of the embodiment of FIG. 5.

With reference to FIGS. 5 and 6, if it is desired to make the securing device of a thicker type of strand, instead, a plurality of strands may be woven together as shown in FIGS. 5 and 6. FIG. 5 shows a securing device 50 with a woven strand 51 wound around and around about itself to create the device shown. A securing device such as the device 13 in FIG. 1 may be utilized to retain the wound appearance of the securing device. Of course, a plurality of devices 13 may suitably be employed as desired, not only in the embodiment of FIGS. 5-6 but as well in the embodiments of FIGS. 1-4. FIG. 6 shows a plurality of strands 51*a*, 51*b* and 51*c* woven together to create the strand 51.

Figure 7:
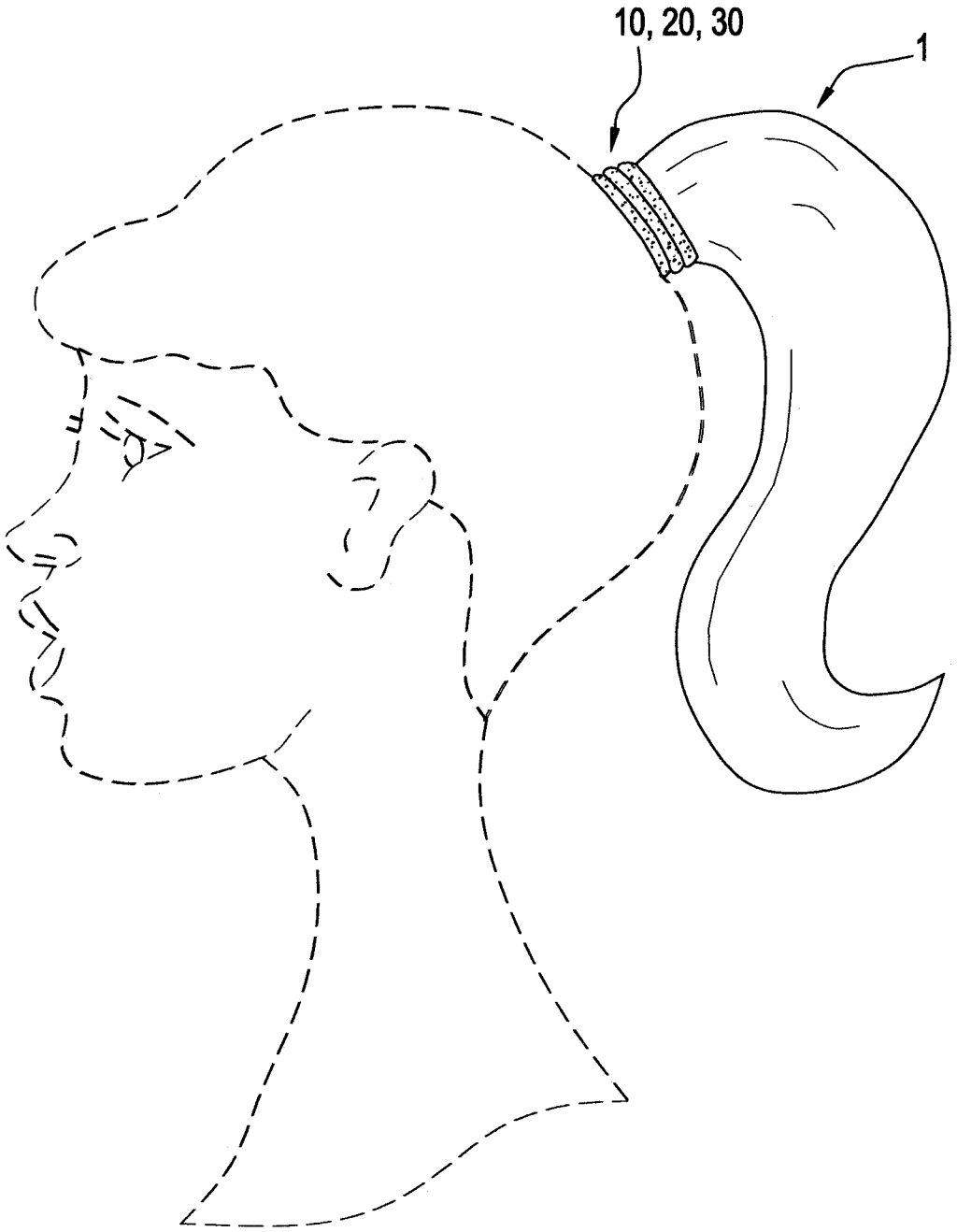
FIG. 7 shows a side view of a device such as illustrated in FIGS. 1-3 used to secure a ponytail.
Figure 8:
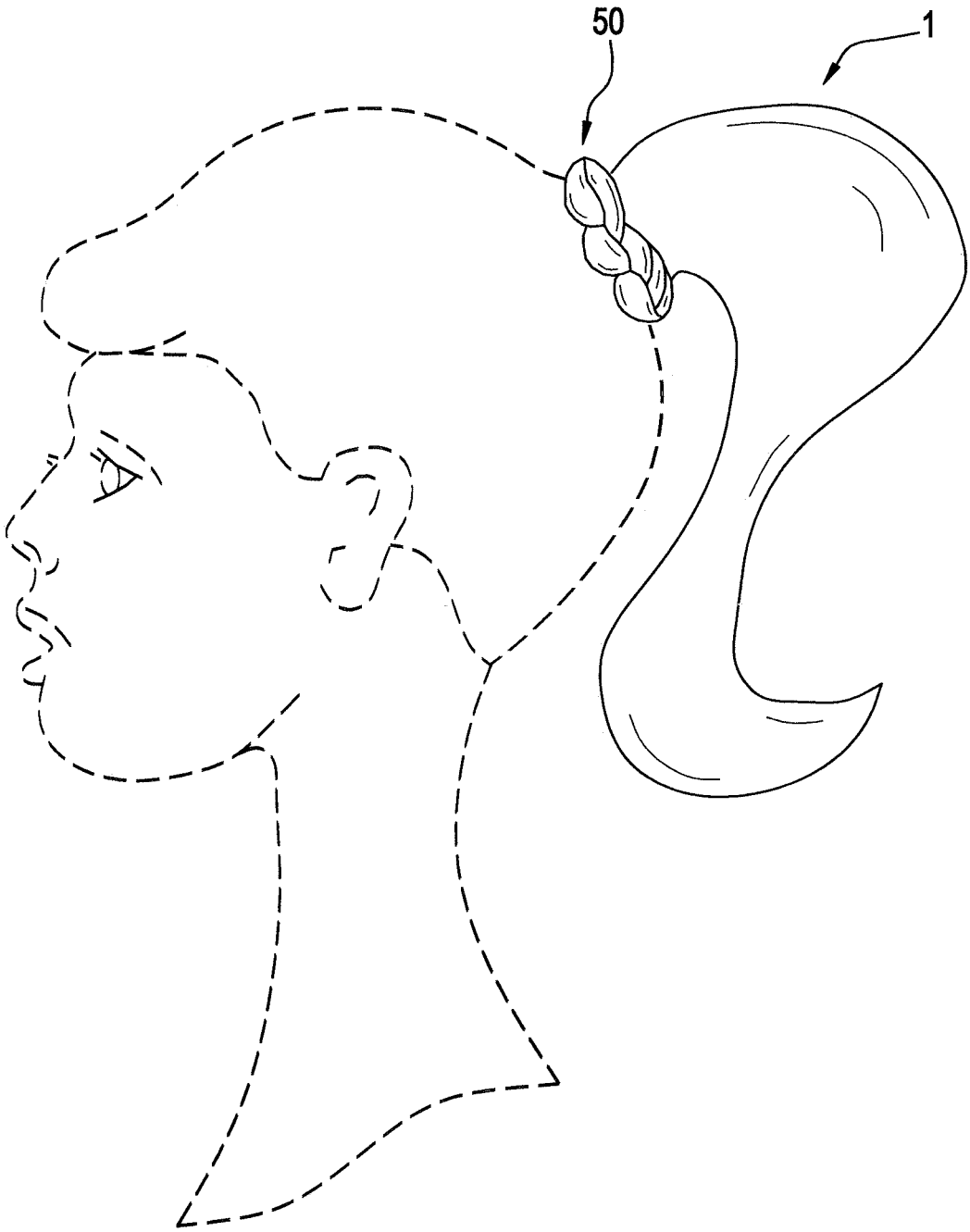
FIG. 8 shows a side view of a device such as shown in FIGS. 5 and 6 used to secure a ponytail.

FIGS. 7 and 8 show the appearance of a ponytail 1 as created using embodiments of the present invention. FIG. 7 shows the embodiment of any one of FIGS. 1-3 and FIG. 8 shows the embodiment of FIGS. 5-6.

Figure 9:
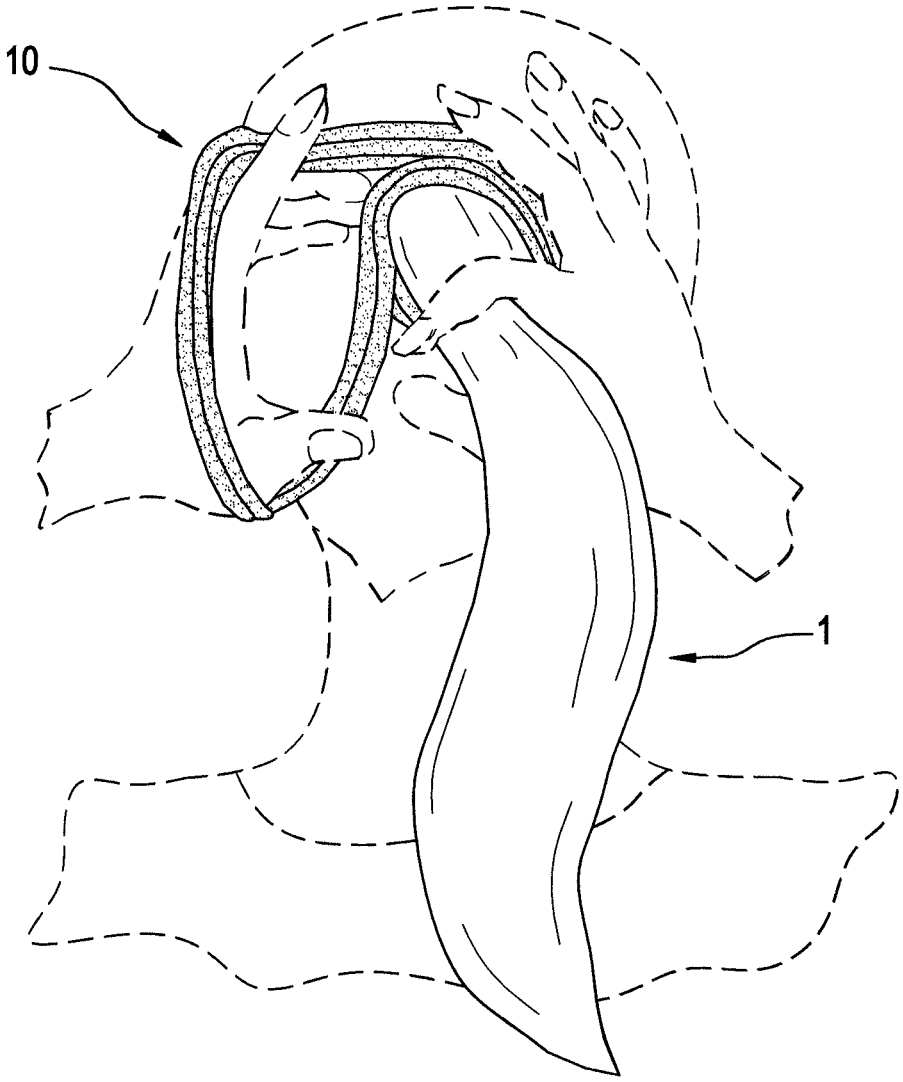
FIG. 9 shows a step in the process of securing one of the embodiments of the present invention to create a ponytail.

FIG. 9 shows part of the process for installing the ponytail securing device of the present invention. In FIG. 9, as exemplary, the strand 10 is shown with the ponytail 1 being created. As shown, the strand 10 wound in plural windings is placed around the hair and then twisted to create another loop, whereupon it is made to receive the ponytail a second time. When the securing device is released, its elasticity causes it to spring back and thereby retain the ponytail in the manner shown in FIGS. 7 and 8.

Figure 10:
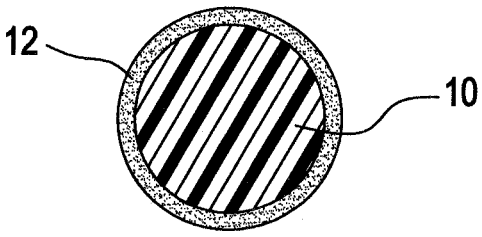
FIG. 10 shows a cross-section through a typical elastic fiber of the present invention showing a coating of dye thereon.

FIG. 10 shows an example of a strand such as the strand 10 with a layer of dye 12 adhered about its periphery. FIG. 10 is exemplary of all the embodiments of the present invention which as explained above are intended to be able to receive and retain a hair dye or acid dye adhered thereto.

As such, an invention has been disclosed in terms of preferred embodiments thereof which fulfill each and every one of the objects of the invention as set forth hereinabove, and provide a new and useful ponytail securing device of great novelty and utility.

Of course, various changes, modifications and alterations in the teachings of the present invention may be contemplated by those skilled in the art without departing from the intended spirit and scope of the present invention.

As such, it is intended that the present invention only be limited by the terms of the appended claims.

The invention claimed is:

1. A hair securing device comprising:

a singular elastic strand having a relaxed diameter of 0.25 mm to 1.5 mm wound about a single axis to form a concentric plurality of hollow loops, said loops being substantially equal in diameter and fastened in such arrangement that binds the loops together at a discrete location;

said elastic strand dyed to a color matching a color of human hair and adapted to receive a group of hairs of a user within the hollow loops and hold said hairs together as said group of hairs.

2. The hair securing device of claim 1, wherein said elastic strand has a degree of elasticity wherein it may be stretched to a length at least twice a relaxed length thereof.

3. The hair securing device of claim 1, wherein said elastic strand is made of a material chosen from the group consisting of a proportion of polyurethane and a proportion of titanium dioxide.

4. The hair securing device of claim 1, wherein said dye is chosen from the group consisting of an acid dye and a hair dye.

5. The hair securing device of claim 1, wherein a plurality of beads are attached to said elastic strand at spaced locations thereon.

6. The hair securing device of claim 1, wherein said elastic strand is formed of a plurality of strands braided together.

7. The hair securing device of claim 6, wherein said plurality of braided strands comprises three strands.

8. A ponytail securing device comprising:

a) an elongated elastic strand wound about a single axis forming a plurality of concentric hollow loops having a substantially same diameter;

b) said elastic strand having a relaxed diameter of 0.25 to 1.5 mm and being stretchable to at least twice its relaxed length;

c) at least one fastener-holding said concentric loops together to form a singular annular shape; and d) said ponytail securing device adapted to receive a group of hairs and hold said hairs together to form a ponytail.

9. The ponytail securing device of claim 8, wherein said elastic strand is made of a material chosen from the group consisting of a proportion of polyurethane and a proportion of titanium dioxide.

10. The ponytail securing device of claim 8, further wherein the elastic strand is dyed with a material chosen from the group consisting of an add dye and a hair dye.

11. The ponytail securing device of claim 8, wherein said elastic strand is formed of a plurality of strands braided together.

12. The ponytail securing device of claim 11, wherein said plurality of braided strands comprises three strands.

* * * * *